United States Patent [19]

Haag et al.

[11] Patent Number: 4,900,462

[45] Date of Patent: Feb. 13, 1990

[54] POLAR LUBRICATING FLUID AND A METHOD FOR ITS SYNTHESIS

[75] Inventors: Werner O. Haag, Lawrenceville, N.J.; Robert E. Palermo, New Hope, Pa.

[73] Assignee: Mobil Oil Corp., New York, N.Y.

[21] Appl. No.: 143,439

[22] Filed: Jan. 13, 1988

[51] Int. Cl.[4] ..... C10M 145/00

[52] U.S. Cl. ..... 252/52 R; 252/56 R; 252/56 S; 560/243; 568/909

[58] Field of Search ..... 252/56 R, 52 R, 56 S; 560/243; 568/909, 909.5

[56] References Cited

U.S. PATENT DOCUMENTS

| | | | |
|---|---|---|---|
| 3,471,532 | 10/1969 | Young | 560/243 |
| 3,914,203 | 10/1975 | Lee . | |
| 3,919,176 | 11/1975 | Meyer, Jr. et al. . | |
| 4,041,098 | 8/1977 | Loveless . | |
| 4,158,664 | 6/1979 | Selwitz et al. . | |
| 4,161,452 | 7/1979 | Stambaugh et al. . | |
| 4,167,486 | 9/1979 | Rowe . | |
| 4,282,157 | 8/1981 | van der Voort . | |
| 4,313,893 | 2/1982 | Pesa et al. | 560/243 |
| 4,451,679 | 5/1984 | Knifton et al. | 568/909 |
| 4,451,680 | 5/1984 | Knifton | 568/909 |
| 4,508,874 | 4/1985 | Hergenrother et al. . | |
| 4,566,983 | 1/1986 | Hayashi . | |
| 4,628,985 | 12/1986 | Jacoby et al. . | |
| 4,652,539 | 3/1987 | Alvila et al. | 568/909 |
| 4,658,053 | 4/1987 | Green . | |

*Primary Examiner*—Jacqueline V. Howard
*Attorney, Agent, or Firm*—Alexander J. McKillop; Charles J. Speciale; Dennis P. Santini

[57] ABSTRACT

A polar lubricating fluid comprising aliphatic molecules having hydroxy or ester functional groups. The alcohol lubricant molecules have at least 20 carbon atoms and the ester molecule comprises between 26 and 100 carbon atoms. The oxygenate content of both molecules is at least 0.2 mmoles per gram of lubricant. The alcohol lubricating fluid is produced by a process comprising hydroformylating olefins having at least 20 carbon atoms in the presence of a hydroformylating catalyst and synthesis gas comprising $H_2$ and CO. The ester lubricating fluid is produced by a subsequent acylation. The reaction is carried out between 150° C. and 300° C.

19 Claims, 3 Drawing Sheets

POLAR LUBRICATING FLUID AND A METHOD FOR ITS SYNTHESIS

BACKGROUND OF THE INVENTION

1. Field of the Invention

The invention relates to synthetic polar lubricating fluids derived from hydrocarbon compounds and a method for their synthesis.

2. Discussion of the Prior Art

Conventional lubricating fluids can be prepared by combining saturated hydrocarbons with an additive package having constituents which impart favorable properties to lubricating fluids. In particular, they help reduce friction between moving parts, reduce metal reactivity and corrosion, and prevent formation of gum and varnish. The compositions of additive packages are well known and comprise constituents such as those disclosed in "Lubrication and Lubricants." *Kirk-Othmer-Encyclopedia of Chemical Technology,* 3rd Ed., Vol. 14, pages 490–496. However, to solubilize the additives, substantial quantities of polar compounds must be added. For example, in the past, adipate esters such as bis-tridecanol adipate have been added in amounts of about 20% by weight.

When one adds such large amounts of material into a lubricant, properties such as seal swell, viscometry and oxidation stability become a concern. Seal swell measures the ability of a lubricant to swell a seal, thus enhancing its sealing function. Oxidative stability of a lubricant represents the lubricant's resistance to oxidation and its tendency to form gum and sediment. The viscometric properties concern the viscosity and viscosity index of the material. When materials deficient in these properties are added in large amounts, the lubricant's effectiveness will be impaired.

In consideration of the above, the polar solubilizing agents usually add seal swell capacity, but may not have viscometric properties or resistance to oxidation comparable to that of the basestock. By adding the solubilizing agent, these properties will be impaired. Furthermore, most of these polar materials, such as the adipates, are expensive, and it would be desirable to produce a lubricant in a more economical fashion.

The present invention provides a high molecular weight, aliphatic lubricant which has sufficient polarity to adequately dissolve additive packages without the addition of solubilizing agents such as adipate esters. As a result of hydroformylation, the lubricant molecules contain hydroxy or ester groups which are responsible for the polarity of the fluid.

In the past low molecular weight aliphatics having hydroxy groups or esters have been produced as lubricating fluids. Furthermore, it is known that low molecular weight olefins can be hydroformylated at about 100° C. to produce an aldehyde. The subsequent hydrogenation of the aldehyde to produce a primary alcohol is also known. (see U.S. Pat. No. 4,658,053). This process involves two steps and it would be easier, and more economical, if the lubricating fluid could be produced in one step.

SUMMARY OF THE INVENTION

It is the purpose of this invention to provide a polar lubricating fluid having enough solvent power to dissolve a lubricant additive package without the addition of polar blending constituents such as adipate ester. It comprises high molecular weight, aliphatic hydrocarbon moieties bearing a primary OH group and having at least 20 carbon atoms. Furthermore, the hydroxy functional groups can be acylated to produce esters having the same or similar properties. The esters comprise 26 to 100 carbon atoms. They exhibit seal swell capacity for rubber conventionally used in seals. Furthermore, the esters have greater solvent power than the conventional lubricant absent the addition of adipate ester. They also possess viscometric properties which are nearly identical to those of the conventional lubricant absent the adipate esters and have solvent power identical to that shown by the lubricant blended with adipate esters.

The invention is also directed to a method for synthesizing polar lubricating fluids. It comprises the hydroformylation of olefins having at least 20 carbon atoms in the presence of a hydroformylating catalyst and synthesis gas comprising hydrogen and carbon monoxide. At a temperature in a range of 150°–300° C., this reaction produces, in a single step, primary alcohols. To produce a lubricating fluid molecule bearing ester groups, the hydroxy groups are then reacted with an acylating agent.

In these products, alcohol and ester groups are referred to as oxygenates. Both the alcohol and ester lubricants have an oxygenate content of at least 0.2 mmole functional group per gram of lubricant, and preferably at a content in the range of 0.2–3.2 mmol/g per gram.

The above process produces optimal lubricating fluids when the olefins are 24–60 carbon atom oligomers of alpha olefins having 8 to 12 carbon atoms, or oligomerized mixtures of 8 to 12 carbon olefins.

DETAILED DESCRIPTION

Lubricating Fluid

Figure 1:
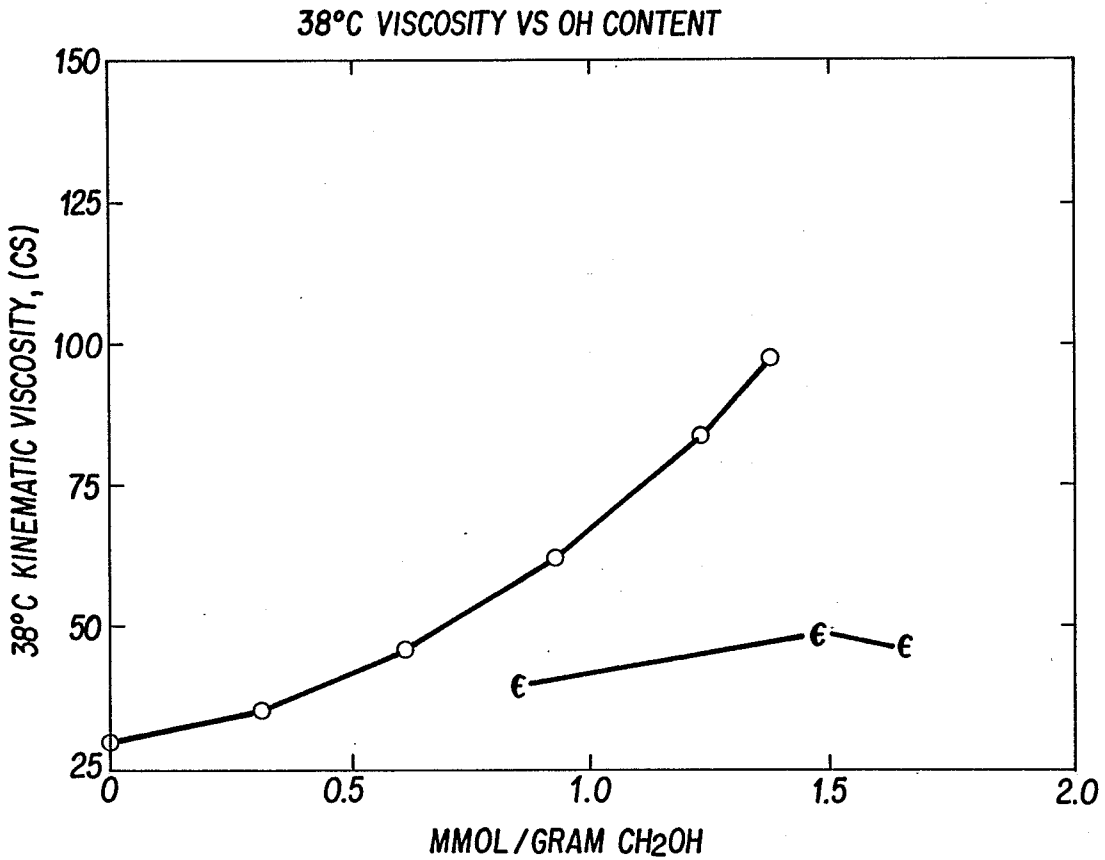
FIG. 1 is a graph comparing viscosities at 38° C. of lubricants having hydroxy and ester functional groups versus the amount of molecules having these groups. The line (o—o) is for blends of alcohol lubricant with various portions of conventional lubricants resulting from hydrogenation of decene trimer. Other points: (e) represents ester lubricating fluids; for ester examples the abscissa is mmol/gram —$CH_2OAc$.

In order to dissolve additive packages, the molecules of the instant lubricating fluid have functional groups which impart polarity. The functional group consists of at least a primary hydroxy or an ester of the hydroxy. While hydrocarbon moieties with a hydroxy functional group; have long been known, synthetic alcohols of sufficient molecular weight, oxidative stability and viscosity to be lubricating fluids have not been known. Specifically, the present invention relates to a polar lubricating fluid comprising primary aliphatic alcohols having at least 20 carbon atoms. Furthermore, the present invention includes a polar lubricating fluid comprising primary aliphatic esters having 26 to 100 carbon atoms, preferably 30 to 60. At 100° C. this fluid also has a viscosity greater than 3 cs and a viscosity index greater than 120, and preferably has a viscosity greater than 5 cs and viscosity index greater than 130. Both the alcohol and ester lubricants have an oxygenate content of at least 0.2 mmole per gram of lubricant, and the preferred range of oxygenate content is 0.2–3.2 mmol per gram.

The instant fluids are the products of the following hydroformylation of olefins.

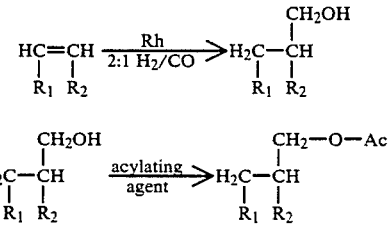

wherein $R_1$ and $R_2$ are hydrocarbon moieties and Ac is an aliphatic or aromatic acyl moiety. As the following discussion illustrates, the esters possess viscometric properties favorable for lubricants.

Lubricants produced from olefins by hydrogenation have long been known to have good viscometric properties. For example, decene oligomers have been used in the past as the olefin which is hydrogenated to conventional lubricating fluids. At 38° C. and 98° C., the viscosities of the lubricants produced from a decene trimer have been measured to be 29.6 and 5.43 centistokes (cs) respectively. The viscosity index (VI) has been measured to be 132. The prior art use of a polar constituent to solubilize additive packages may result in the impairment of these viscometric properties.

On the other hand, the instant lubricating fluids possess viscometric properties similarly advantageous to those of the conventional lubricants absent a polar solubilizing agent. The instant ester fluids have a comparable viscosity index, but have the additional benefit of a somewhat higher viscosity than those of the conventional lubricants. For example, these more viscous fluids can alleviate the need to include viscosity enhancers as part of an additive package.

Specifically, lubricants comprising molecules having the ester functional groups have been measured to have viscosities of 46.9 cs and 7.40 cs at 38° C. and 98° C. respectively and a VI of 132. See Table 1. Table 1 compares the viscosities and VIs of samples of the instant fluids with those of known lubricating fluids.

Lubricating fluid molecules having the hydroxy functional groups are shown to have substantially higher viscosities than those of the conventional fluids and a lower viscosity index. Specifically, they are measured to have viscosities of 123.6 cs and 9.67 cs at 38° C. and 98° C. respectively and a VI of 44. See Table 1. This material shows potential for use as an energy-conserving, lubrication fluid due to the low viscosity index, e.g. as the temperature of the alcohol lubricant increases, the less viscous the fluid becomes and the less friction across the surface over which the lubricant is spread.

TABLE 1

| Sample | 38° C. Visc. | 98° C. Visc. | VI |
|---|---|---|---|
| hydrocarbon basestock[1] | 29.6 cs | 5.43 cs | 132 |
| alcohol[2] | 123.6 | 9.67 | 44 |
| ester[3] | 46.9 | 7.40 | 132 |

As demonstrated by the above results, the alcohol lubricant possesses high viscosities compared to the conventional lubricant. The high viscosity at 38° C. is probably due to intermolecular association via hydrogen bonding. As the temperature increases to 98° C., more energy is available to overcome association barriers, and thus the viscosity of the liquid is substantially diminished. This accounts for the low VI.

In contrast, the viscosities of the acetate lubricant are somewhat higher at both test temperatures 38° C. and 98° C. For example, they are 40% and 60% higher than those for the conventional lubricant. The ester functional groups contribute dipole-dipole interactions to the intermolecular forces, and the lubricant molecules having the ester groups do not have the strong temperature dependence shown by the alcohols. Consequently, the ester lubricant has a VI comparable to the known lubricant (i.e., both have VI of 132).

The alcohol and ester lubricants contain at least 0.2 mmole of oxygenates per gram of lubricating fluid. This provides the lubricant with enough polarity so as to dissolve the additive package just as readily as the conventional lubricant blended with adipate esters can. Of course this minimum is varied depending on the number of olefin bonds present on the olefin from which the instant fluid is derived. Furthermore, the oxygenate content required depends on the solubility of the additive package to be dissolved. The instant fluids can therefore be modified to increase or decrease the oxygenate content depending on the additive package to be dissolved.

Figure 2:
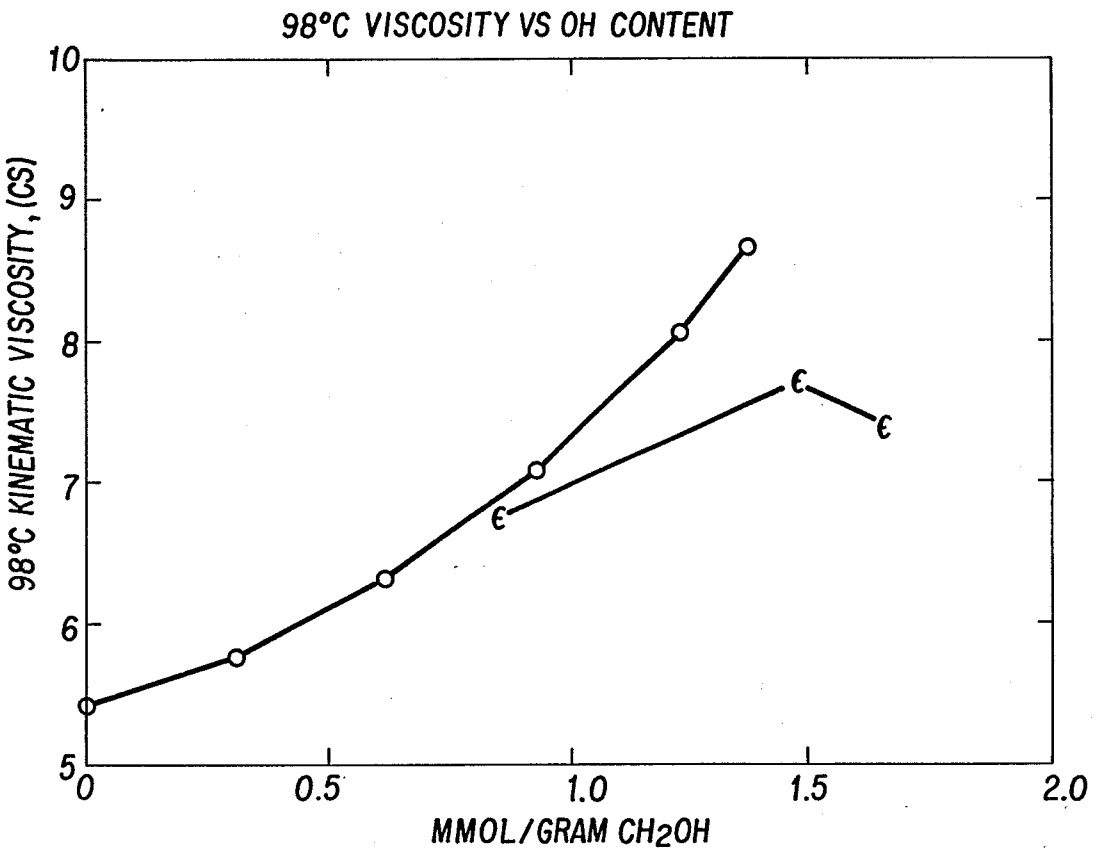
FIG. 2 is a graph comparing viscosities at 98° C. of lubricants having hydroxy and ester functional groups versus the amount of molecules having these groups. The line (o—o) is for blends of alcohol lubricants with various portions of conventional lubricants resulting from hydrogenation of decene trimer. Other points: (e) represents esters lubricating fluids; for ester examples the abscissa is mmol/gram —$CH_2OAc$.
Figure 3:
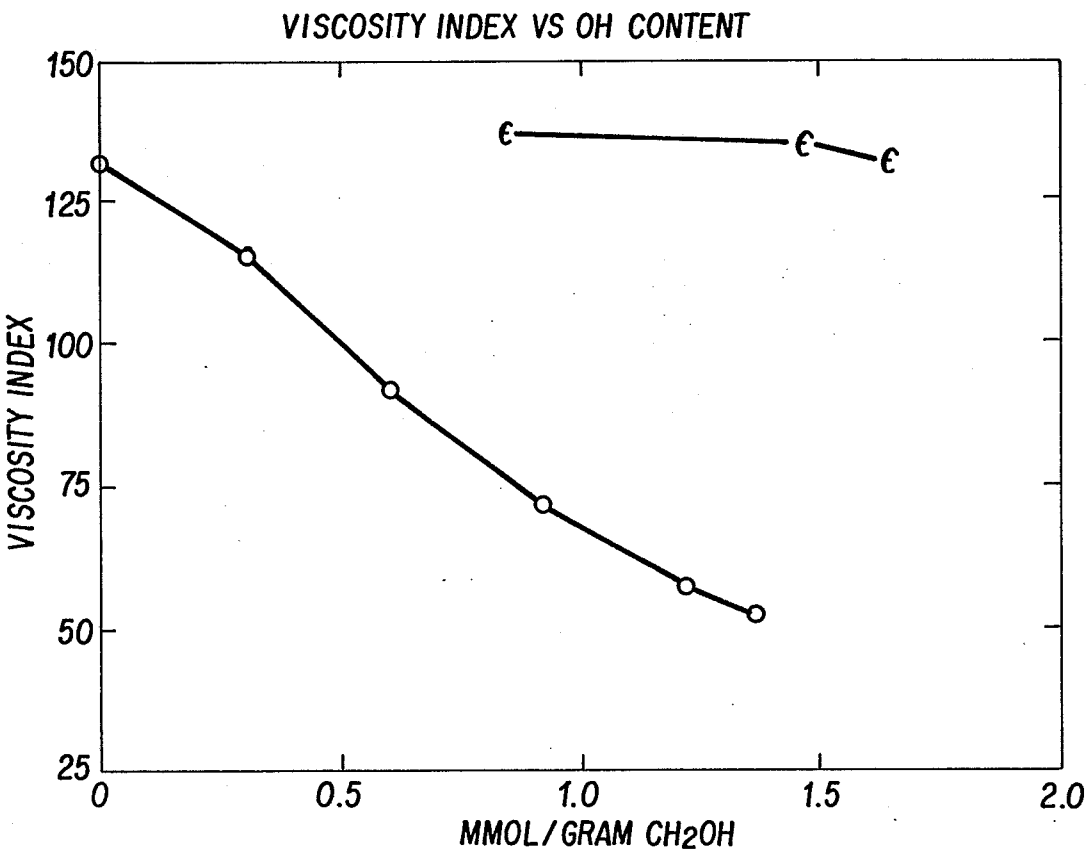
FIG. 3 is a graph comparing viscosity indexes of ester and alcohol lubricants versus the amount of molecules having these respective functional groups. The line (o—o) is for blends of alcohol lubricating fluid with various portions of conventional lubricants resulting from hydrogenation of decene trimer. Other points: (e) represents ester lubricating fluids; for ester examples the abscissa is mmol/gram —$CH_2OAc$.

Also, the viscosity of the alcohol lubricant can be varied by increasing or decreasing the number (mmol/g) of molecules with primary alcohol functional groups. In FIGS. 1 and 2 of the drawings, it can be seen that the viscosity increases as the millimolar amount of the OH functional groups per gram of lubricant is increased. Likewise, as shown in FIG. 3 of the drawings, as the number of molecules having functional groups increases, the VI of the lubricant decreases due to intermolecular bonding previously discussed. As a result of these properties, lubricants of varying VI's can be produced according to the lubricant's intended use. This lends itself to highly designable lubricating materials.

On the other hand, the ester lubricants have level viscometric properties. As also shown by FIGS. 1 and 2, the amount of ester functional groups present in the lubricant does not appear to significantly affect the viscosity of the lubricant. Consequently, no matter how many ester groups are present, an essentially uniform VI can be expected. Therefore, one need not worry about controlling the amount of ester groups present, because as FIG. 3 shows, even if the amount of ester molecules per gram of lubricant is over 1.5 mmol/gram, the viscosity index of the lubricant product remains the same as that when there are less than 1 mmol per gram of lubricant. This is important because this allows control of the polarity and solvent power of the lubricant (oxygenate content) within wide limits without affecting the viscosity index.

Not only do the above lubricating fluids have desirable viscometric properties, but the fluids possess seal swell capacity and solvent power. Specifically, the ester lubricants demonstrate seal swell capacity with Buna-N Rubber, a typically used rubber sealant. See Table 2.

TABLE 2

Seal Swell Capacity of acetate ester of decene trimer

| | Sample #1[a] | Sample #2[a] | Base Stock Blend[b] |
|---|---|---|---|
| Seal Swell Buna-N Rubber After 70 h at 300° F. | | | |
| Volume Change, | −1.6 | −2.4 | −0.5 |
| Hardness Change | +4 | +2 | +3 |
| Cracking | None | None | None |

[a]Sample #1 contained 1.6 mmol-$CH_2OOCCH_3$ groups per gram lubricant; Sample #2 contained 0.8 mmol-$CH_2OOCCH_3$ groups per gram lubricant.
[b]Basestock blend contains 25 wt % bis-tridecanol adipate, 75 wt % hydrogenated decene trimer.

The lubricants also show solubilization of commonly used additive packages. As set out in Table 3, precipitation after mixing the ester lube with an additive package was non-existent after 30 days at temperatures of 0° and 150° C. (A=no precipitate). This indicates the solvent power of the ester lube is just as effective as a hydrocarbon lubricant basestock blend which contains an adipate ester. See Table 3.

As Table 3 shows, the lubricant was clear of haze at 150° F. while it shows somewhat more haze at the lower temperatures.

TABLE 3

Solvent power of acetate ester of decene trimer as measured by storage stability.

| | Sample #1[a,b] | Sample #2[a,b] | Base Stock Blend[b,c] |
|---|---|---|---|
| Storage Stability Appearance after 30 days | | | |
| at Room Temperature | 1A | 1A | 1A |
| at 150° F. | 1A | 1A | 1A |
| at 0° F. | 4A | 4A | 2A |

Note:
Haze Scale: 1 = Clean, 2 = Trace, 3 = Light, 4 = Medium, 5 = Heavy
Precipitate Scale: A = None, B = Trace, C = Light, 4 = Medium, 5 = Heavy
[a]Sample #1 contained 1.6 mmol —$CH_2OOCCH_3$ groups per gram lubricant. Sample #2 contained 0.8 mmol —$CH_2OOCCH_3$ groups per gram lubricant.
[b]All materials were tested as blends with 20 wt % of commercial additive package.
[c]Base Stock Blend contains 25 wt % bis-tridecanol adipate, 75 wt % hydrogenated decene trimer.

The alcohols and esters produced also have oxidative stabilities comparable to that of the corresponding hydrocarbons because they have essentially the same structure; also, the added alcohol or ester group is that of a primary R—$CH_2OX$ moiety (X=H,Ac), i.e. it contains only secondary C—H bonds, rather than a more reactive tertiary C—H bond

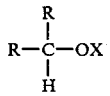

if a secondary alcohol were produced.

Synthesis of Lubricating Fluid

The instant lubricating fluids are synthesized at a temperature in the range of 150°-300° C. by a method comprising the hydroformylation of olefins having at least 20 carbon atoms in the presence of a hydroformylation catalyst and synthesis gas comprising hydrogen ($H_2$) and carbon monoxide (CO). The hydroformylation of olefins to produce aldehydes is common and in a few special cases olefins have been hydroformylated to produce alcohols; however, hydroformylation of high molecular weight olefins with 20 or more carbon atoms, and especially 30 to 60 carbon atoms to produce alcohols in a single step, has not been reported. These heavy olefins result in fluids with optimum lubricating properties. The fluids produced by the prior art hydroformylations are too light for lubrication. Furthermore, the instant process can be carried out on olefins with more than one olefin double bond, e.g. diolefins, and still produce a lubricating fluid with properties comparable to a fluid produced from a monoolefin.

Specifically, an olefin with at least 20 carbon atoms, preferably at least 24, but more particularly preferred between 30 and 60, is hydroformylated. It is especially preferred that the olefins comprise oligomers of alpha olefins having 8 to 12 carbon atoms. U.S. Pat. No. 4,041,098 discloses such an oligomerization and its disclosure is incorporated herein by reference. The hydroformylation is performed at a temperature in the range of 150°-300° C., preferably in the range of 150°-200° C. where the yield of alcohol in the hydroformylation product reaches 100%. The ratio of $H_2$ to CO can be between 0.5:1 and 5:1 with a preferred ratio range between 1:1 and 3:1. A particularly preferred ratio is 2:1. The catalyst comprises either rhodium, cobalt or ruthenium. Especially preferred are catalysts selected from the group consisting of coordination complexes, carbonyl compounds and hydrocarbonyl compounds. Specific examples include $RhCl_3$, $Rh_2O_3$, $Rh_2(CO)_4Cl_2$, $Rh_4(CO)_{12}$, $Rh_6(CO)_{16}$, $RhH(CO)_2[P(Ph)_3]_2$, $CoCl_2$, $Co_2(CO)_8$, $HCo(CO)_4$, $Co_4(CO)_{12}$, $Co_2(CO)_6(n\text{-}Bu_3P)_2$, cobalt napthenates, $Ru_3(CO)_{12}$, $H_2Ru(CO)_2[P(Ph)_3]_2$, and $H_4Ru_4(CO)_8[P(Ph_3)]_4$.

The resulting primary alcohols can then be acylated to esters. The acylating agent can be acyl halides, carboxylic acids, acid anhydrides or carboxylic esters described by the following formula:

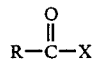

wherein R=a hydrocarbon with 1 to 20 carbon atoms and for acyl halides, X=a halogen atom with Cl preferred for carboxylic acid, X=OH for acid anhydrides, X=OOCR′ wherein R′ has 1 to 20 carbon atoms and may or may not have as many carbon atoms as R for carboxylic esters, X=OR″ wherein R″ has 1 to 20 carbon atoms, preferably less than 10.

Specific examples of acyl halides are acetyl chloride, acetyl bromide, propionyl chloride, butanoyl chloride, etc. Examples of carboxylic acid acylating agents are butanoic acid, pentanoic acid, hexanoic acid, etc. Examples of acid anhydrides are acetic anhydride, propanoic anhydride, butanoic anhydride, etc. Examples of carboxylic ester agents are methyl acetate, ethyl acetate, ethyl propanoate, ethyl butanoate, etc. Difunctional acylating agents are also useful.

The following examples are presented as only illustrative and are not to be considered to limit the scope of the invention.

EXAMPLE 1

A decene trimer having an average molecular weight of 480 ($C_{34}H_{68}$), was hydroformylated in either a 300 ml or liter stainless steel autoclave. Specifically, the autoclave was charged with 549 g (1.14 moles) of an olefin feed (decene trimer) in the presence of 0.677 g ($6.35\times10^{-4}$ moles) of $Rh_6(CO)_{16}$ [purchased from Alfa Corp.]. The reaction was carried out at 150° C. and 1000 psig. $H_2$/CO reactant gas [from a Matheson Certified Standard mixture of perpurified $H_2$ and CP grade CO] was reacted with the olefin feed at a ratio of 1:1. These gases were scrubbed through activated carbon to remove volatile metal carbonyls.

After 170 hours, the reaction vessel was emptied and its contents centrifuged, filtered, and tested for functional group content, % conversion of double bonds, etc. The viscosity index of resulting composition was 45.8.

COMPARATIVE EXAMPLE

The decene trimer in Example 1 was hydroformylated at only 100° C. for 120 hours in the presence of $Rh_6(CO)_{16}$ whereby the weight amount of Rh metal equaled 0.05% of the amount of the olefins. The resulting fluids contained 100% aldehydes. 36% of the olefins' double bonds were converted.

EXAMPLE 2

The trimer in Example 1 was hydroformylated under the same conditions except the reaction was carried out for 140 hours and the weight amount of Rh metal equaled 0.09% of the amount of olefins. The resulting fluids contained 90% alcohols and 10% formate esters. 81% of the olefins' double bonds were converted and the oxygenate content of the resulting fluid was 1.57 mmol per gram of lubricant. The viscosity index was 40.

EXAMPLE 3

The reaction conducted was the same conducted in Example 2 except that the reaction was carried out for 150 hours. The resulting fluid contained 73% alcohols, 13% formate esters, and 14% aldehydes. 71% of the olefins' double bonds were converted and the oxygenate content of the resulting fluid was 1.42 mmol/g. The viscosity index of the fluid was 73.

EXAMPLE 4

The reaction conducted was the same as that conducted in Example 2 except the reaction was carried out for 170 hours and the weight amount of Rh metal equaled 0.07% of the amount of olefins. The resulting fluid contained 97% alcohols and 3% formate esters. 81% of the olefins' double bonds were converted and the oxygenate content of the resulting fluid was 1.59 mmol/g. The viscosity index was 46.

EXAMPLE 5

The reaction conducted was the same as that conducted in Example 4 except that it was carried out for only 130 hours. The resulting fluid contained the same percentage of the same compounds in Example 4, but the viscosity index of the fluid in this example was 49, and 84% of the olefins' double bonds were converted. The oxygenate content of the resulting fluid was 1.67 mmol/gram of lubricant.

EXAMPLE 6

383.4 g (0.613 moles) of the primary alcohol obtained in Example 1 and 147 g (1.86 moles) of pyridine were combined and reacted with 97 g (0.95 moles) of acetic anhydride. The reaction was carried out at room temperature for 24 hours under a $N_2$ atmosphere. At the end of the reaction, the phases were allowed to separate. The reaction produce was centrifuged out, filtered and tested for functional group content. The VI of the produce was 132.4.

While specific embodiments of the compound and process aspects of the invention have been shown and described, it should be apparent that modifications can be made thereto without departing from the spirit and scope of the invention. Accordingly, the invention is not limited by the foregoing description, but is only limited by the scope of the claims.

We claim:

1. A polar lubricating fluid comprising a mixture of primary aliphatic alcohols having at least 20 carbon atoms and having at least 0.2 mmol of oxygenate per gram of fluid, a viscosity of at least 123.6 cs at 38° C. and a viscosity index greater than 44.

2. A polar lubricating fluid comprising a mixture of primary aliphatic esters having 26 to 100 carbon atoms wherein at 100° C. said fluid has a viscosity greater than 3 cs and a viscosity index greater than 120.

3. A polar lubricating fluid according to claim 2 wherein said fluid contains at least 0.2 mmol of oxygenate per gram of said fluid.

4. A polar lubricating fluid according to claim 1 or 2 wherein said fluid has an oxygenate content in the range of 0.2–3.2 mmol per gram of lubricant.

5. A polar lubricating fluid according to claim 2 wherein said mixtures of esters have 30 to 60 carbon atoms.

6. A polar lubricating fluid according to claim 2 wherein said fluid has a viscosity greater than 5 cs and a viscosity index greater than 130.

7. A method for synthesizing a polar lubricating fluid comprising hydrocarbon moieties bearing at least one functional group selected from the group consisting of hydroxy and an ester of said hydroxy, comprising hydroformylating at a temperature in the range of 150°–300° C. olefins having at least 20 carbon atoms in the presence of a hydroformylation catalyst selected from the group consisting of rhodium and rhodium oxides and in the presence of synthesis gas comprising $H_2$ and CO to produce an alcohol, and, for the production of an ester, subsequently acylating said alcohol.

8. A method according to claim 7 wherein said olefins contain at least 24 carbon atoms.

9. A method according to claim 8, wherein said olefins contain 30 to 60 carbon atoms.

10. A method according to claim 7, wherein said rhodium catalyst is a member selected from the group consisting of a coordination complex, a carbonyl and a hydrocarbonyl.

11. A method according to claim 10, wherein said catalyst is $Rh_6(CO)_{16}$.

12. A method according to claim 7, wherein the $H_2$/CO ratio is in the range of 0.5:1 to 5:1.

13. A method according to claim 12, wherein the $H_2$/CO ratio is in the range of 1:1 to 3:1.

14. A method according to claim 12, wherein the $H_2/CO$ ratio is 2:1.

15. A method according to claim 7, wherein the esters of the primary alcohols are produced using an acylating agent of formula $$R-\overset{\overset{\displaystyle O}{\|}}{C}-X$$

wherein

R=a hydrocarbon having 1 to 20 carbon atoms

X=Cl, Br, I, OH, OR′ or OOCR″ wherein R′=a hydrocarbon having 1–20 carbons, and wherein R″=a hydrocarbon having 1 to 20 carbon atoms.

16. A method according to claim 15 wherein R′ contains less than 10 carbon atoms.

17. A method according to claim 7, wherein said olefins are oligomers of alpha olefins having 8 to 12 carbon atoms.

18. A method according to claim 17 wherein the olefins contain at least 24 carbon atoms.

19. A method according to claim 8 wherein the olefins contain 30 to 60 carbon atoms.

* * * * *

UNITED STATES PATENT AND TRADEMARK OFFICE

CERTIFICATE OF CORRECTION

PATENT NO. : 4,900,462

DATED : February 13, 1990

INVENTOR(S) : W.O. Haag et al

It is certified that error appears in the above-identified patent and that said Letters Patent is hereby corrected as shown below:

| | |
|---|---|
| Col. 4, Table | Insert footnote for Table 1 as follows: --[1] hydrogenation product of a decene trimer without the addition of adipate ester. [2] alcohol derived from hydroformylation of decene trimer. [3] acetate ester of derived alcohol.-- |
| Col. 6, line 40 | "$H_2Ru(CO)_2[P(Ph)_3]_2$" should be --$H_2Ru(CO)_2[P(Ph)_3]_2$-- |
| Col. 10, claim 19, line 11 | "8" should be --18-- |

Signed and Sealed this

Twenty-sixth Day of March, 1991

*Attest:*

*Attesting Officer*

HARRY F. MANBECK, JR.

*Commissioner of Patents and Trademarks*